US007572171B2

(12) United States Patent
Tsuchida

(10) Patent No.: US 7,572,171 B2
(45) Date of Patent: Aug. 11, 2009

(54) CUTTING-TOOL HOLDER USED FOR GRINDING

(75) Inventor: Mino Tsuchida, Funabashi (JP)

(73) Assignee: Master Cutlery Corporation, Funabashi, Chiba (JP)

( * ) Notice: Subject to any disclaimer, the term of this patent is extended or adjusted under 35 U.S.C. 154(b) by 434 days.

(21) Appl. No.: 11/234,387

(22) Filed: Sep. 26, 2005

(65) Prior Publication Data

US 2007/0072521 A1 Mar. 29, 2007

(30) Foreign Application Priority Data

Sep. 12, 2005 (CA) ..... 2518835

(51) Int. Cl.
*B24B 1/00* (2006.01)
*B24B 19/16* (2006.01)

(52) U.S. Cl. ..... 451/45; 24/489; 24/499; 294/99.2; 451/378; 451/439

(58) Field of Classification Search ..... D7/683, D7/686; D8/72, 73, 394, 395; 24/455, 489, 24/499; 30/492; 294/99.2; 451/45, 367, 451/378, 439; 452/195
See application file for complete search history.

(56) References Cited

U.S. PATENT DOCUMENTS 2,437,495 A * 3/1948 Anderson ..... 451/371
3,911,531 A * 10/1975 Buturuga ..... 24/10 R
3,924,360 A * 12/1975 Haile et al. ..... 451/371
D356,340 S * 3/1995 Browning, Jr. ..... D19/91
6,227,958 B1 * 5/2001 Neuberg ..... 451/367
D498,497 S * 11/2004 Lo ..... D19/65
D521,368 S * 5/2006 Carl ..... D8/395
D561,552 S * 2/2008 Tsuchida ..... D8/71

FOREIGN PATENT DOCUMENTS

JP 2004160636 6/2004

* cited by examiner

*Primary Examiner*—Timothy V Eley
(74) *Attorney, Agent, or Firm*—Banner & Witcoff, Ltd.

(57) ABSTRACT

A cutting-tool holder (1) used for grinding includes a holder body (10) including a pair of pinching pieces (11, 11) biased to each other; and a pair of handgrips (30, 30) provided on the holder body (10) which sets the pair of pinching pieces (11, 11) apart from each other by applying force to the handgrips (30, 30). The holder body (10) may further include a connecting portion (12) with a nearly C-shaped cross section which connects base end parts (11*c*, 11*c*) of the pinching pieces (11, 11). Each handgrip (30) may be configured so that one end part (30*a*) is fixed to the pinching piece (11), the middle part penetrates the connecting portion (12), and the other end part extends away from the pinching piece (11).

5 Claims, 4 Drawing Sheets

CUTTING-TOOL HOLDER USED FOR GRINDING

BACKGROUND OF THE INVENTION

The present invention relates to a cutting-tool holder used for grinding a cutting tool on a grinding stone, and in particular, to a cutting-tool holder which keeps a grinding angle formed by a blade of a cutting tool and a surface of a grinding stone constant.

BRIEF SUMMARY OF THE INVENTION

In one aspect of the present invention, a cutting-tool holder used for grinding is provided which includes a pinching member comprising a pair of pinching pieces biased to each other; and a pair of handgrips provided on the pinching member for setting the pair of pinching pieces apart from each other by applying force to the pair of handgrips in a direction to move the handgrips toward each other.

According to this aspect of the invention, upon attaching the holder to the cutting tool, pressing the handgrips sets the pinching pieces apart from each other. Into a space formed between the pinching pieces, a cutting tool is inserted, and releasing the handgrips closes a pair of pinching pieces to hold the cutting tool therebetween. Since there is no need to slide the cutting tool over the inner face of the cutting-tool holder upon attaching the holder to the cutting tool, the cutting tool can be prevented from being damaged. In addition, during grinding, the angle which the blade forms with the grinding stone is kept constant. Moreover, upon detaching the holder from the cutting tool, pressing the handgrips sets the pinching pieces apart from each other, and the cutting tool can be simply removed from the space between the pinching pieces. To put it simply, the holder can be easily attached to or detached from the cutting tool.

Further, upon cleaning the holder, the pinching pieces can be set apart from each other by pressing the handgrips. While keeping the pinching pieces apart, the grinding waste accumulated between the pinching pieces can be washed or wiped out.

The above pinching member may preferably but not necessarily further comprises a connecting portion with a generally C-shaped cross section which connects a base end of a first pinching piece to a base end of a second pinching piece. Each of the above handgrips preferably but not necessarily has one end part being fixed to the pinching piece, the middle part penetrating the connecting portion, and the other end part extending away from the pinching piece.

With this structure, the grinding position of the cutting tool is guided by abutting the connecting portion and the blade on the grinding stone, and therefore the angle which the blade forms with the grinding stone can be maintained constant. In addition, since the handgrips penetrate the connecting portion and extend from one side of the connecting portion to the other side, the handgrips will not interfere with the grinding stone during grinding operation.

The above cutting-tool holder may preferably but not necessarily be provided with a protective member to cover the inner face of each pinching piece.

By providing a protective member on the inner faces of the pinching pieces, a holder can be attached to the cutting tool without causing any damage. Even when the holder slides over the cutting tool during grinding operation, the cutting tool can be prevented from being damaged.

The above protective member may preferably but not necessarily be configured so as to further cover the front end edge of each pinching piece.

By configuring the protective member to cover the front end edge of the pinching pieces, the cutting tool can be prevented from being damaged even when the front end edges of the pinching pieces touch the cutting tool during attachment of the holder on the cutting tool. Moreover, the user can be prevented from being hurt by the pinching pieces.

BRIEF DESCRIPTION OF THE FIGURES

The various aspects, other advantages and further features of the present invention will become more apparent by describing in detail illustrative, non-limiting embodiments thereof with reference to the accompanying drawings.

FIG. 5A shows a state in which a holder is attached to a kitchen knife and placed on a surface of a grinding stone; FIG. 5B shows a state in which the kitchen knife is pressed against the grinding stone; and FIG. 5C shows a state in which the kitchen knife is ground.

DETAILED DESCRIPTION OF THE INVENTION

The embodiments of the present invention will be described below in detail in reference to the accompanying drawings. It should be noted that in the present embodiment a kitchen knife is used as an example of the cutting tool, however, the present invention should not be limited to this particular embodiment, and appropriate cutting tools other than kitchen knife are applicable.

The cutting-tool holder is used for maintaining the angle which the blade forms with the grinding stone constant, during a grinding operation.

Figure 1:
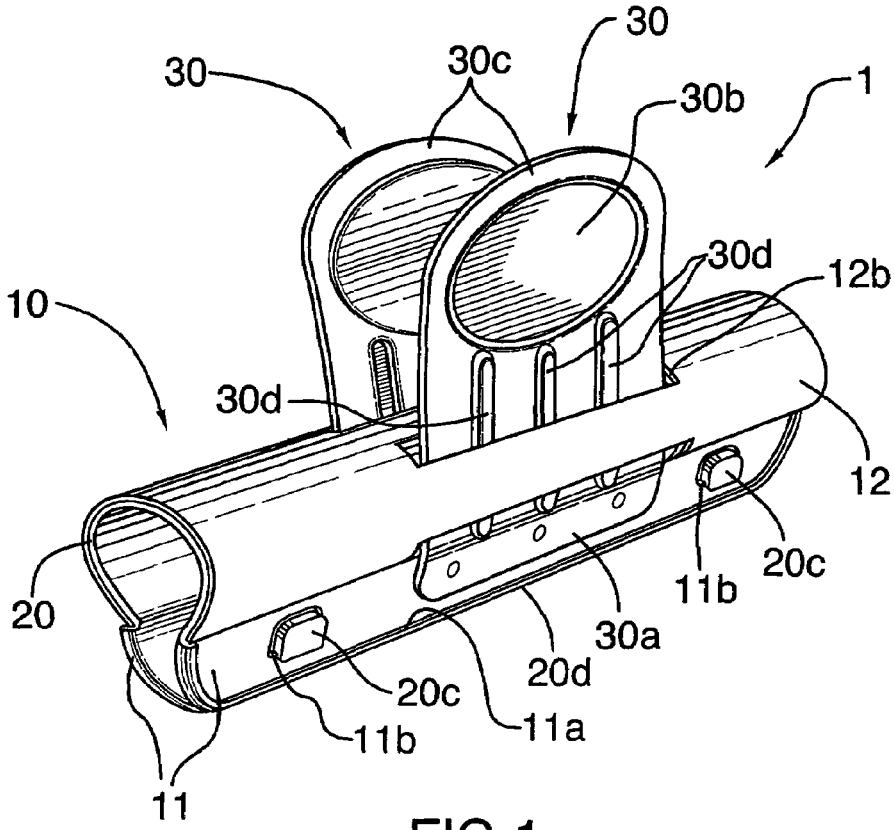
FIG. 1 shows a perspective view of a cutting-tool holder used for grinding according to one embodiment of the present invention.

As shown in FIG. 1, a cutting-tool holder 1 used for grinding according to the present embodiment includes a holder body 10 (pinching member), a protective member 20 fixed to the inner face of the holder body 10, and a pair of handgrips 30, 30 provided on the holder body 10. The cross section of the, overall structure has left-right symmetry (see FIG. 3).

The holder body 10 may be formed by press molding a metal plate, such as a stainless steel plate and/or steel plate, and includes a pair of pinching pieces 11, 11 for pinching a kitchen knife 2 (see FIG. 6) and a connecting portion 12 that connects a first pinching piece 11 and a second pinching piece 11. As is clearly seen in the figures, and especially the cross-sections of the cutting-tool holder shown in FIGS. 3 and 4, the holder body 10 (pinching member) in one piece.

Figure 2:
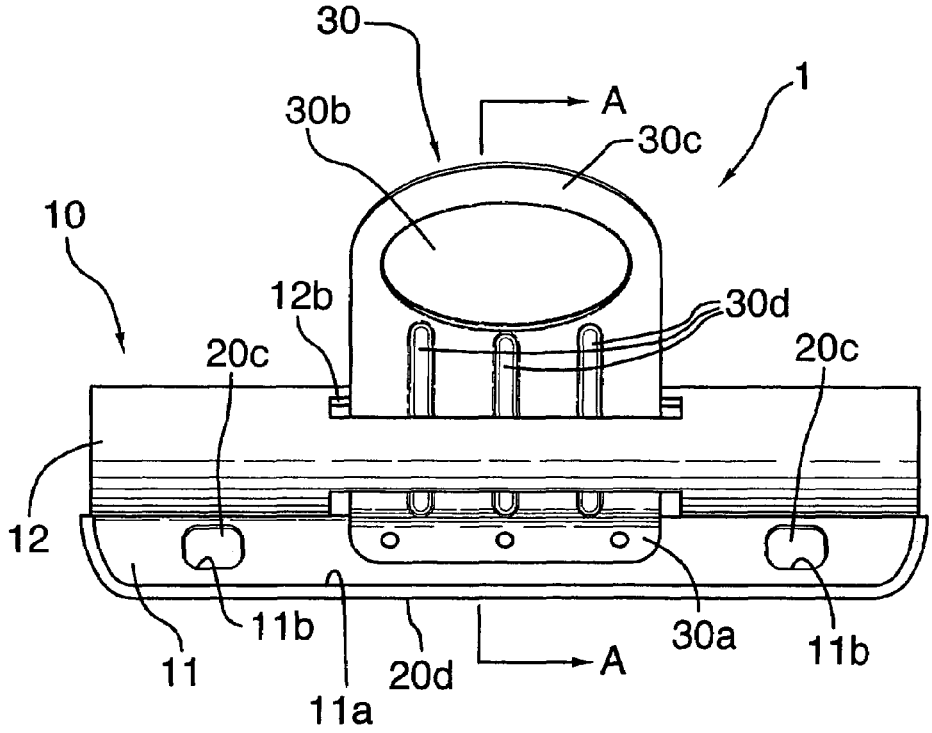
FIG. 2 shows a front view of a cutting-tool holder used for grinding according to one embodiment of the present invention.

As shown in FIG. 2, each pinching piece 11 has a nearly rectangular shape when seen from the front. The pinching pieces 11, 11 are connected to each other through the connecting portion 12 (which will be described below) in such a manner that the front end edges 11*a*, 11*a* are biased to each other (see FIG. 13). In each lengthwise end part of each pinching piece 11, an oval through hole 11*b* is formed.

Figure 3:
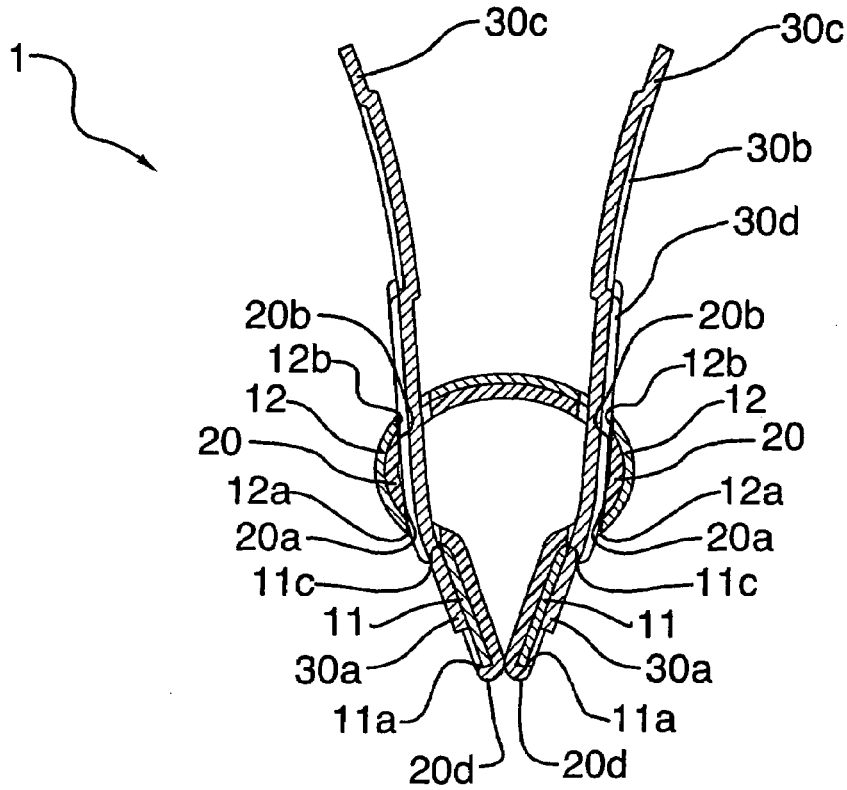
FIG. 3 shows a cross section of a cutting-tool holder taken along the line A-A in FIG. 2.
Figure 4:
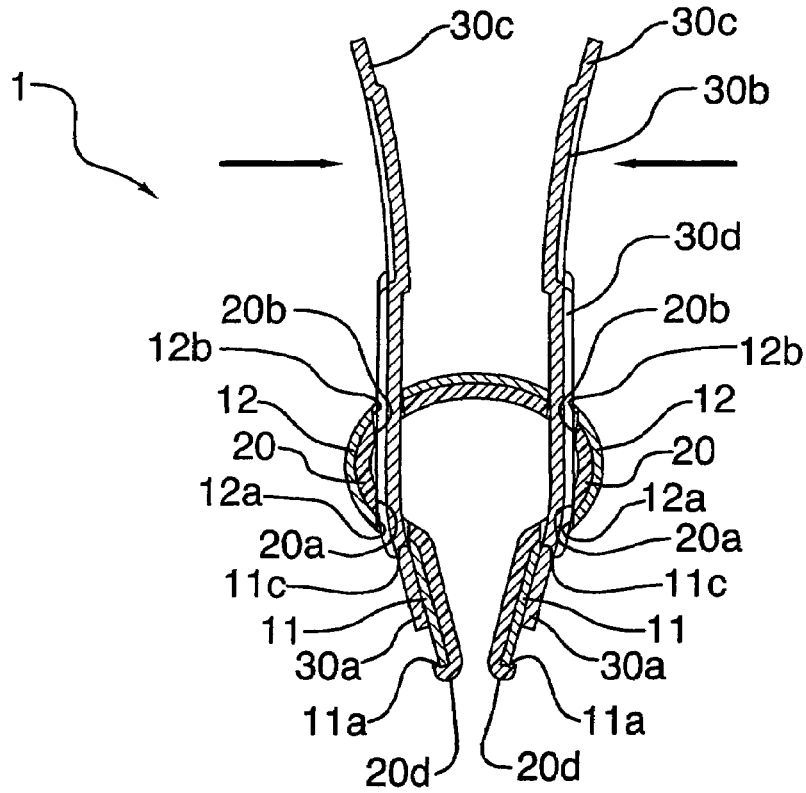
FIG. 4 shows a cross section of a cutting-tool in which pinching pieces are set apart from each other.

FIG. 3 shows a cross section of a cutting-tool holder taken along the line A-A in FIG. 2, and FIG. 4 shows a cross section of a cutting-tool holder in which the pinching pieces are set apart from each other.

As shown in FIG. 3, the connecting portion 12 has a generally C-shaped cross section, and connects the pinching pieces 11 on the base end parts 11*c*. In the connecting portion 12, four through holes are punched: two openings 12*a* each provided along the base end part 11*c* of the pinching piece 11 and two openings 12*b* each provided vertically facing the opening 12*a* (see FIG. 2).

The protective member 20 is formed of material having hardness lower than that of the kitchen knife 2 to be ground (see FIG. 6), such as synthetic resins including high-density polyethylene (HDPE). The protective member 20 is configured to have nearly the same shape as the inner periphery of the holder body 10, and fixed to the inner face of the holder body 10. With this structure, when a holder body 10 is attached on the kitchen knife 2, the kitchen knife 2 contact the protective member 20 and is not brought into contact with the hard holder body 10, which therefore prevents the kitchen knife 2 from being damaged.

On the protective member 20, through holes 20*a* and 20*b* are provided at positions corresponding to the positions of the openings 12*a* and 12*b* in the holder body 10. Also on the protective member 20, protrusions 20*c* are provided at positions corresponding to the positions of the through holes 11*b* (see FIGS. 1 and 2). By embedding the protrusions 20*c* in the corresponding through holes 11*b* in the holder body 10, the position of the protective member 20 relative to the holder body 10 is guided and fixed. The front end portions 20*d*, 20*d* of the protective member 20 are turned up so as to cover the front end edges 11*a*, 11*a* of the pinching pieces 11. With this structure, even when the front end edges 11*a*, 11*a* of the pinching pieces 11 are directed toward the kitchen knife 2, the kitchen knife 2 can be prevented from being damaged. Moreover, the user can be prevented from being hurt by the front end edges 11*a*.

Like the holder body 10A, the pair of handgrips 30, 30 is formed of, for example, metal plate, such as stainless steel. The handgrips are configured so that the front end edges 11*a*, 11*a* of the pinching pieces are set apart from each other when the handgrips are pressed (see FIG. 4). Each handgrip 30 is inserted into the openings 12*b*, 20*b*, 20*a* and 12*a* in the holder body 10 and the protective member 20. In other words, the handgrip 30 penetrates the holder body 10 and the protective member 20. The end part 30*a* of each handgrip 30 is fixed to the outer face of the pinching piece 11 by, for example, welding. Since the handgrips 30 are fixed to the holder body while penetrating the holder body 10, interference between the handgrips 30 and the grinding stone 3 is prevented during grinding operation (see FIG. 5).

Each handgrip 30 may have a contact portion 30*b* to facilitate pinching of the handgrips by a user's fingers. The portions 30*b*, 30*b* may be formed by stamping. As well, the end part 30*c* of each handgrip 30 may be slightly curved such that the end parts 30*c*, 30*c* are biased away from one another to further assist with gripping. Each handgrip 30 may be reinforced with a plurality of ribs 30*d* formed by stamping for example.

In the cutting-tool holder 1 used for grinding having the above-mentioned configuration, the pinching pieces 11, 11 can be set apart from each other by applying a force to the handgrips 30, 30 in the direction of getting close to each other. While keeping the pinching pieces 11, 11 apart, the holder is attached to the kitchen knife 2 on the blunt edge 2*a* (see FIG. 6). In this manner, to avoid sliding contact between the pinching pieces 11, 11 and the kitchen knife 2, the cutting-tool holder 1 can be attached to the blunt edge 2*a* of the kitchen knife 2. Therefore, the kitchen knife 2 can be prevented from being damaged.

Figure 5A:
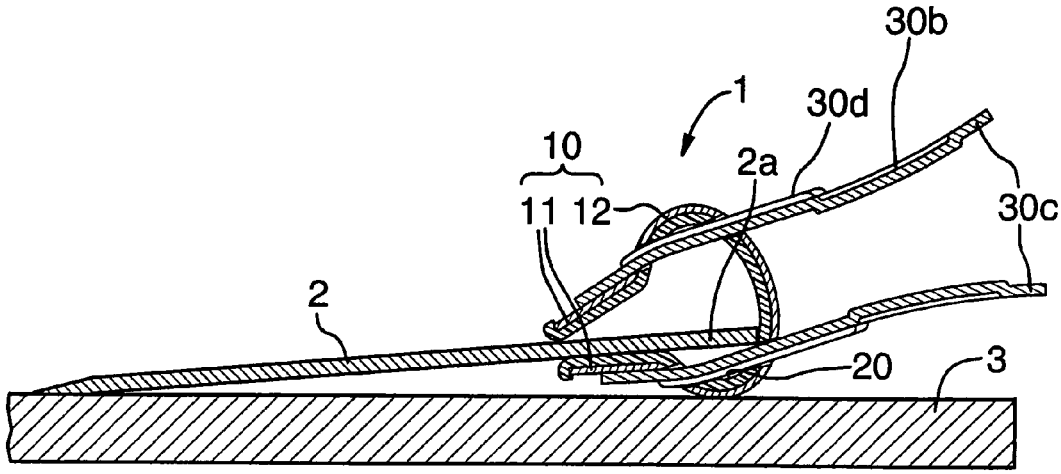
FIGS. 5A-5C show side sectional views explaining the mechanism of grinding a kitchen knife.
Figure 5B:
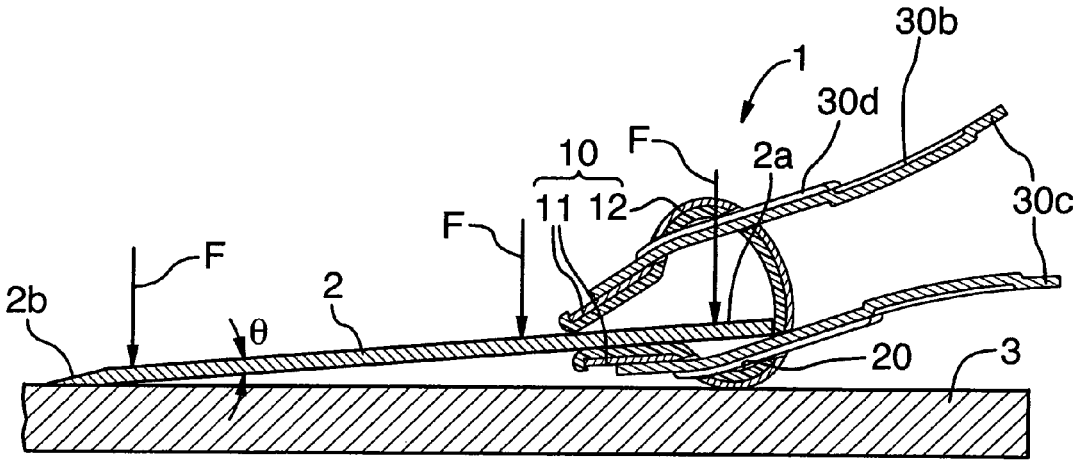
Figure 5C:
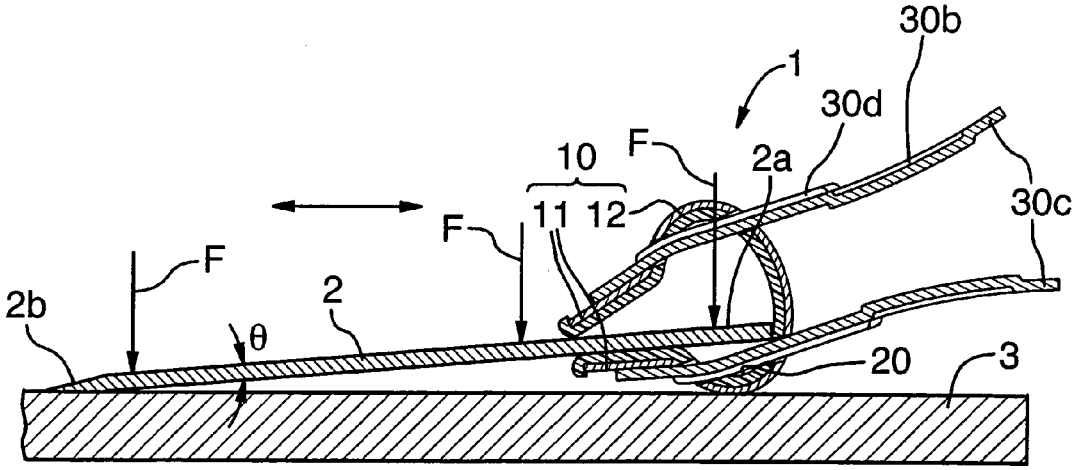
Figure 6:
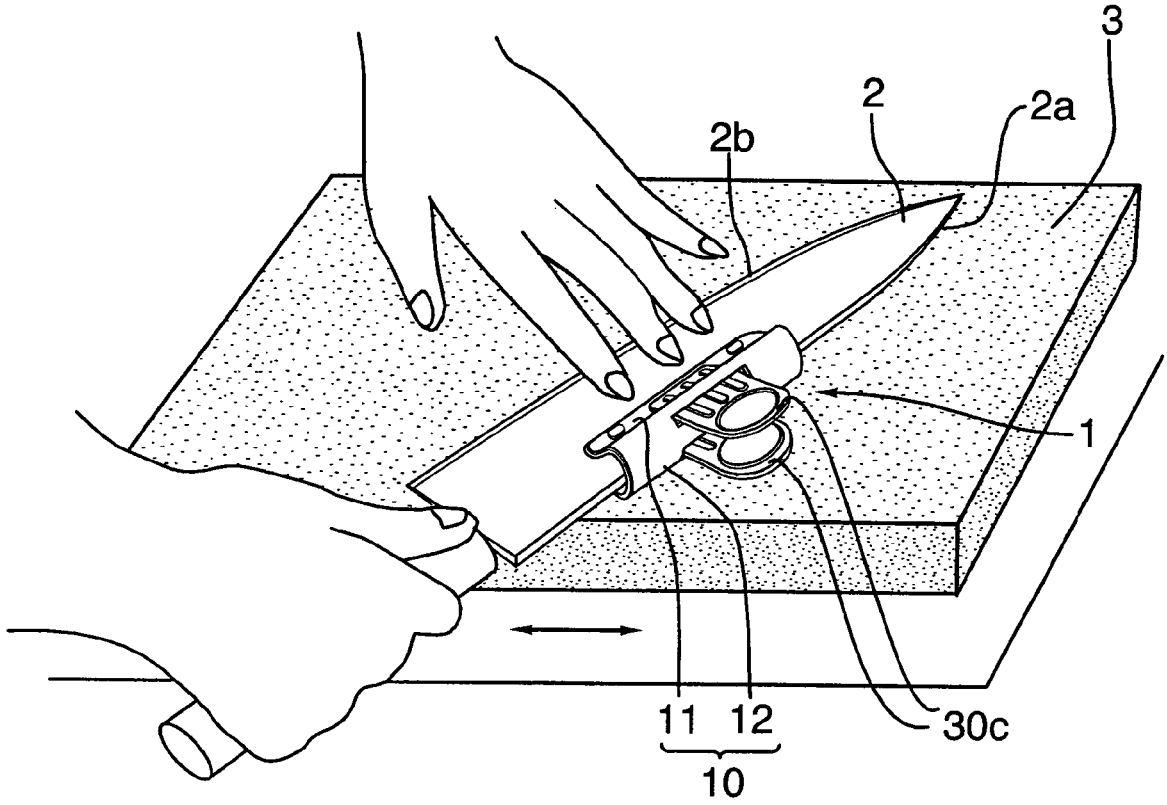
FIG. 6 shows a perspective view of the cutting-tool holder of the present embodiment in use.

A method for grinding the kitchen knife 2 using the cutting-tool holder 1 will be explained below with reference to FIGS. 5 and 6. FIGS. 5A-5C show side sectional views explaining the mechanism of grinding a kitchen knife; FIG. 5A shows a state in which a holder is attached to a kitchen knife and placed on a surface of a grinding stone; FIG. 5B shows a state in which the kitchen knife is pressed against the grinding stone; and FIG. 5C shows a state in which the kitchen knife is ground. FIG. 6 shows a perspective view of the cutting-tool holder of the present embodiment in use.

First, referring to FIG. 5A, a holder 1 is attached to a kitchen knife 2 on a blunt edge 2*a* thereof. The kitchen knife 2 with the holder 1 is placed on a grinding stone 3 set on a stable surface, (e.g. such that while a connecting portion 12 and a blade 2*b* of the kitchen knife 2 are abutting on the grinding stone 3. As shown in FIG. 5B, a user pushes down the kitchen knife 2 to the grinding stone 3 with a force F. By applying the force F on the kitchen knife 2, a surface of the kitchen knife 2 is brought into close contact with a lower pinching piece 11, and an angle θ which the blade 2*b* forms with the grinding stone 3 is kept constant. There is no limitation with respect to the angle θ, but approximately 15° is preferred. The shape of the cutting-tool holder 1 used for grinding may be designed in accordance with the desired angle θ.

Next, referring to FIGS. 5C and 6, the user slides the kitchen knife 2 over the grinding stone 3, while maintaining the state shown in FIG. 5B, that is, the state in which the connecting portion 12 and the blade 2*b* are abutting on the grinding stone 3. In this manner, one side (grinding side) of the blade 2*b* is ground. When burrs appear on the side of the blade 2*b* opposite to the grinding side, the kitchen knife 2 with the holder 1 is flipped, and the opposite side is ground in the same manner. Accordingly, the blade 2*b* of the kitchen knife 2 can be sharpened. During grinding, a lubricant, such as water or oil, may be used depending on the properties of the materials of the grinding stone 3 and the kitchen knife 2.

When the grinding is completed, force is applied to the handgrips 30, 30 in the direction of getting close to each other, thereby setting the pair of pinching pieces 11, 11 apart from each other (see FIG. 4), and the holder 1 is detached from the kitchen knife 2. In this manner, the cutting-tool holder 1 according to the present embodiment can be easily removed from the kitchen knife 2 without causing any damage on the kitchen knife 2. In addition, since the pair of the pinching pieces 11, 11 can be put in the opened position, any grinding waste accumulated between the pinching pieces 11, 11 can be washed or wiped out from the inner faces 11*d*, 11*d* of pinching pieces 11, 11.

According to the cutting-tool holder used for grinding of the embodiment described above, the following effects can be obtained.

Since the kitchen knife 2 is ground while abutting the connecting portion 12 and the blade 2*b* of the kitchen knife 2 on the grinding stone 3, the angle which the blade 2*b* forms with the grinding stone 3 is kept constant, and therefore sharpening of the blade 2*b* is facilitated.

In addition, the holder 1 can be attached to/detached from the kitchen knife 2 while keeping the pinching pieces 11, 11 apart from each other, and therefore the attachment/detachment of the holder 1 is facilitated. The holder 1 can be attached/detached without sliding the holder 1 over the kitchen knife 2, and therefore the kitchen knife 2 is prevented from being damaged.

Moreover, the pair of the pinching pieces 11, 11 can be put in the opened position and grinding waste accumulated during grinding can be easily cleaned from the inner faces 11*d*, 11*d* of the pinching pieces 11, 11. Therefore, damage on the surface of the kitchen knife 2, which may be given by the grinding waste remaining after washing, can be prevented.

The embodiment of the present invention has been described above, however, the present invention is not limited to the particular embodiments discussed above and variations and modifications may be made thereto. For example, the pinching pieces 11, 11 are biased not necessarily by utilizing the elasticity of the pinching member, and the same effect can be attained by a coil spring.

It is also apparent that the materials and the shapes of the various components of the present invention can vary depending on the type of the cutting tool to be ground.

All patents and patent applications cited in this disclosure are expressly incorporated herein by reference. The above disclosure generally describes the present invention. A more complete understanding can be obtained by reference to the following specific examples, which are provided for purposes of illustration only and are not intended to limit the scope of the invention.

All patents and patent applications cited in this disclosure are expressly incorporated herein by reference. The above disclosure generally describes the present invention. A more complete understanding can be obtained by reference to the following specific examples, which are provided for purposes of illustration only and are not intended to limit the scope of the invention.

What is claimed is:

1. A cutting-tool holder used for grinding comprising:

a one piece pinching member comprising a pair of pinching pieces biased to each other, the pinching member further comprising a connecting portion with a generally C-shaped cross section which connects a base end part of a first pinching piece to a base end part of a second pinching piece;

a pair of handgrips provided on the pinching member for setting the pair of pinching pieces apart from each other by applying force to the pair of handgrips in a direction to move the handgrips toward each other, each handgrip having a one end part fixed to the pinching piece, a middle part penetrating the connection portion through at least one opening, and another end part extending away from the pinching piece, wherein the connecting portion has a first opening along the base end part of the first pinching piece, a first corresponding opening vertically facing the first opening, a second opening along the base end part of the second pinching piece, and a second corresponding opening vertically facing the second opening.

2. The cutting-tool holder according to claim 1, wherein each handgrip penetrates the connecting portion twice, one of the handgrips extending through the first opening along the base end part and the first corresponding opening vertically facing the first opening and one of the handgrips extending through the second opening along the base end part and the second corresponding opening vertically facing the second opening.

3. The cutting-tool holder according to claim 2, wherein a first end part of each handgrip that is fixed to the respective pinching piece is fixed to an outer face of the respective pinching piece.

4. A cutting-tool holder used for grinding comprising:

a pinching member comprising a pair of pinching pieces biased to each other;

a pair of handgrips provided on the pinching member for setting the pair of pinching pieces apart from each other by applying force to the pair of handgrips in a direction to move the handgrips toward each other;

wherein the pinching member further comprises a connecting portion with a generally C-shaped cross section which connects a base end part of a first pinching piece to a base end part of a second pinching piece;

further wherein the connecting portion has four openings, including a first pair of consecutive openings that vertically face each other and a second pair of consecutive openings that vertically face each other and each handgrip extends through one of the pairs of consecutive openings.

5. The cutting-tool holder according to claim 4, wherein, for each handgrip, one end part of the handgrip is fixed to an outer face of the respective pinching piece.

* * * * *